United States Patent [19]

Simionato

[11] Patent Number: 4,660,356

[45] Date of Patent: Apr. 28, 1987

[54] STEP FEED DEVICE FOR BAG FILLING MACHINES

[75] Inventor: Paolo Simionato, Padua, Italy

[73] Assignee: Simionato S.r.l. Macchine Confezionatrici, Mestrino, Italy

[21] Appl. No.: 782,675

[22] Filed: Oct. 2, 1985

[30] Foreign Application Priority Data

Oct. 24, 1984 [IT] Italy ..... 30890/84[U]

[51] Int. Cl.[4] ..... B65B 9/08; B65B 41/12

[52] U.S. Cl. ..... 53/551; 53/389; 53/550; 53/554

[58] Field of Search ..... 53/550, 551, 552, 553, 53/554, 555, 389, 451, 229; 226/155, 172

[56] References Cited

U.S. PATENT DOCUMENTS

| | | | |
|---|---|---|---|
| 3,710,533 | 1/1973 | Burns | 53/389 |
| 3,739,547 | 6/1973 | Breuko et al. | 53/553 |
| 4,136,505 | 1/1979 | Putnam, Jr. et al. | 53/551 |
| 4,313,288 | 2/1982 | Tassi et al. | 53/229 |
| 4,423,585 | 1/1984 | Monsees et al. | 53/551 |
| 4,532,753 | 8/1985 | Kovacs | 53/552 |

*Primary Examiner*—John Sipos
*Assistant Examiner*—Donald R. Studebaker
*Attorney, Agent, or Firm*—Beveridge, DeGrandi & Weilacher

[57] ABSTRACT

A device for the step feeding of web material for making bags, in automatic bag-filling machines. The device comprises two opposing feeding members which are made to rotate continuously and are supported by slides running along horizontal guides, in order to move alternatively from an advanced position in which they frictionally feed and move forward a sufficient length of web material to form a bag, to a retracted position.

7 Claims, 2 Drawing Figures

STEP FEED DEVICE FOR BAG FILLING MACHINES

BACKGROUND OF THE INVENTION

This invention refers to bag-filling machines, of the type in which a continuous strip or web of material, for example a strip of plastic material for making bags, is fed around and along a vertically disposed tubular guide member, at the lower end of which the individual bags are formed. The bags are subsequently filled with loose material. In particular, the invention aims to improve the devices for advancing and feeding the strip material for forming the bags, along the tubular guide member.

In bag-filling machines currently in use, the material to be packed into bags, is fed in bulk form by means of a vertically disposed tubular member which also serves as a guide for a strip of material to be made into bags, which is fed forward step by step or by pre-established lengths sufficient to make the individual bags which are automatically filled and sealed by welding.

The step by step forward movement of the strip material to form the bags, is achieved by means of revolving or rotating members, for example, in the form of two opposing toothed belts which rest constantly against the strip material and on the tubular guide member. The belts are made to rotate discontinuously, starting and stopping them repeatedly, each time a bag is made, thus subjecting the mechanical members supporting the belts to frequent and sudden starting and stopping phases. The intermittent control systems currently in use are consequently extremely delicate in that they require clutch engaging systems or other types of systems which are liable to break down or to wear out very rapidly, thus limiting the output of the bag-filling machines. These systems become even more critical in the case of high outputs where the control members are subjected to greater stress; moreover, they have a limit beyond which it is not easy nor advisable to further increase the output.

As one bag-filling machine can be used for producing bags of various dimensions which require tubular members of different diameter for guiding the strip material, it is necessary each time to carry out the operations of adjusting the position of the strip feeding members, with a consequent waste of time and slow-down in production.

A scope of this invention is to provide a step by step feed device for feeding a strip material to be made into bags, in bag-filling machines, which is capable of overcoming the drawbacks of the known devices. In particular, a scope of this invention is to provide a device as mentioned previously, which is simple and sturdy in structure, in which the control mechanisms destined to be frequently stopped and restarted have been completely eliminated, thereby substantially reducing the possibilities of breakdowns and at the same time increasing the reliability of the entire bag-filling machine.

A further scope of this invention is to provide a step feeding device of the aforementioned kind, which is capable of operating at high speeds and, therefore, of considerably increasing the output, with respect to the currently known devices.

A still further scope of this invention is to provide a device as mentioned previously, which is capable of adapting automatically to tubular guide members of different diameters, without having to carry out any adjustment whatsoever.

SUMMARY OF THE INVENTION

This is achieved by means of a step feed device for feeding a strip material to be made into bags, in bag-filling machines, in which the feeding members for the strip material are made to rotate continuously, and in which said feeding members are supported by slides running along horizontal guides, in order to move from an advanced position close to the aforesaid tubular member, in which the feeding members frictionally pull and move forward a sufficient length of strip material to make a bag, to a retracted position at a distance from the tubular guide member and from the strip material, remaining in this position for the necessary length of time for the bag to be filled and sealed, after which the feeding members, which are kept constantly in rapid rotation, are once again moved forward and backward in order to make and fill further bags.

BRIEF DESCRIPTION OF THE DRAWINGS

The device according to this invention will be described in greater detail hereunder, with reference to the example of the accompanying drawings in which.

DESCRIPTION OF THE INVENTION

Figure 1:
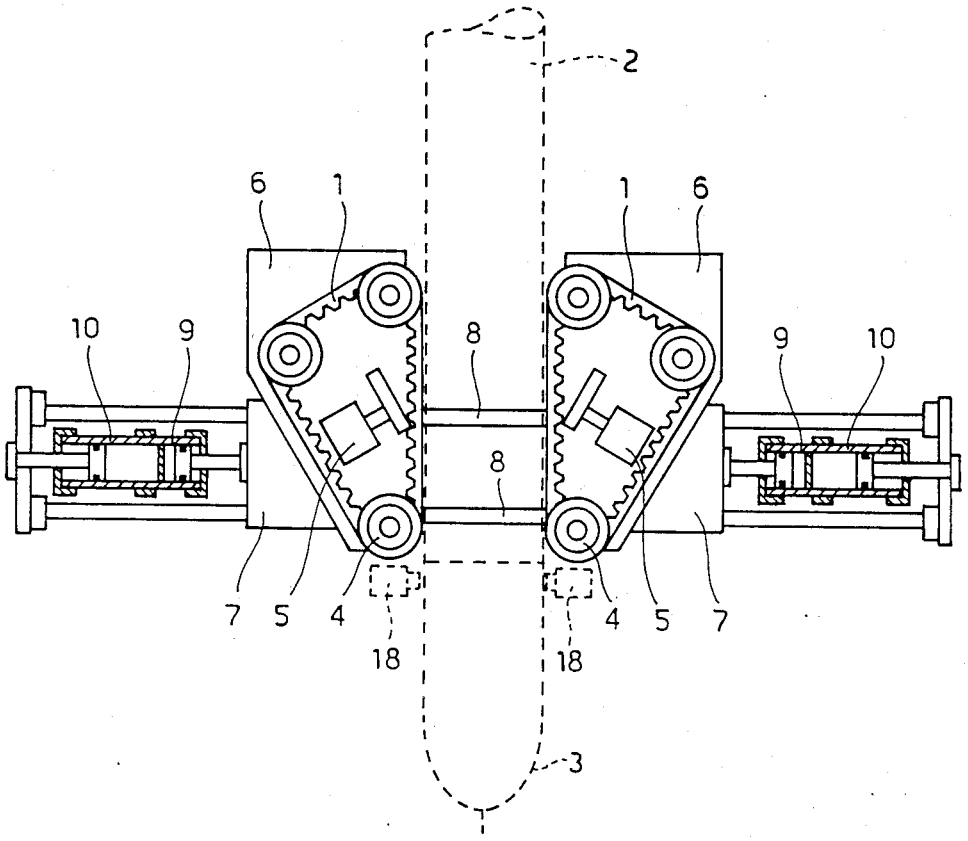
FIG. 1 shows a view of the device, according to a preferred embodiment.

As shown, the step feed device for bag-filling machines comprises a pair of revolving feeding members, in the form of opposing toothed belts 1 which are situated on either side of a vertically arranged tubular element 2 which serves both for feeding a loose material to be packed into bags, and for guiding a strip material, for example, a strip of heat-sealable plastic material which wraps around and slides downwards from above onto the tubular element 2, at the lower end of which are formed the bags 3 to be filled.

The toothed belts 1 each rotate on three pulleys 4, one of which is made to rotate continuously by means of an electric motor, not shown; the three pulleys are situated at the apexes of a triangle so as to present a rectilinear stretch of belt disposed parallel to the outer surface of the tubular element 2. Reference 5 indicates a counting device or a sensor capable of giving an indication of the rotation of the endless belts 1, for the purposes explained further on.

The pulleys 4 for the rotation of each toothed belt 1 are provided on one side of a plate 6 secured to a slide 7 running along horizontal guides 8 which extend along both sides of the tubular element 2. Each slide 7 is actuated to move the toothed belts 1 alternatively from an advanced position in which the belts 1 are in contact with the strip material 3 in order to move it forward on the tubular guide element 2, as shown, to a retracted position in which the belts 1 are spaced at a distance and detached from the tubular element 2 and from the strip material 3.

The simultaneous alternate movement of the two slides 7, towards and away from the tubular element 2, can be achieved by means of any control mechanism whatsoever, for example, by using double-acting cylinders 9, in that they are extremely reliable even when frequently actuated, due to the fact that the short working stroke required for the cylinders 9, which can be kept extremely short, is sufficient to detach the toothed belts 1 from the material 3 in order to form the bags, as well as adapting to tubular elements 3 of different diameters.

Each control cylinder 9 is, in turn, supported by a supplementary control means, for example, by a second double-acting cylinder 10, by means of which it is possible to effect longer movements of the slides 7 in order to shift them as far away as possible from the tubular element 2, whenever it is necessary to carry out repairs or maintenance on the previously described device; in this case too, it is obvious that the two cylinders 10 could be replaced by other control means, for example, by worm screw, cam or electromechanical control means, which can be operated either automatically or manually, without modifying this invention in any way.

Figure 2:
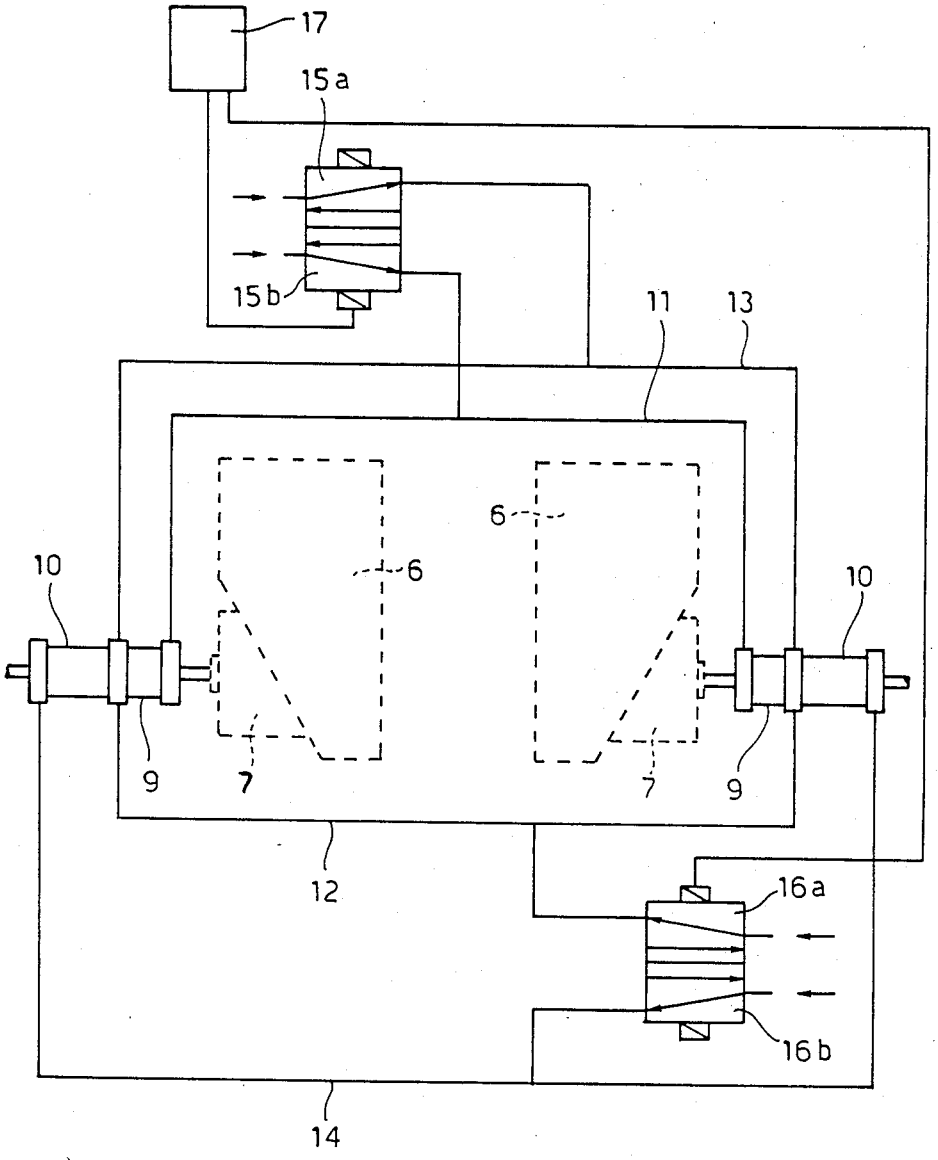
FIG. 2 shows a diagram of the pneumatic control circuit.

As shown in the diagram of FIG. 2, the two cylinders 9 which control the working stroke of the two slides 7 supporting the toothed belts 1 are connected in parallel to each other and to a source of fluid under pressure, together with the supplementary cylinders 10, by means of the ducts 11, 12 and 13, 14 and respective solenoid valves or sets of solenoid valves 15*a*, 15*b*; 16*a*, 16*b* which are controlled by a central control unit 17, which is programmable in order to vary the contact times and distance between the belts 1 and the strip material 3, to make bags of different lengths; the output signals of the aforementioned sensors or counting devices 5 are transmitted to the unit 17.

The device operates in the following way: assuming that the supplementary cylinders 10 are all extended and that the toothed belts 1 or other feeding members are made to rotate continuously. In these conditions, by means of a signal sent by the control unit 17, to the solenoid valves 15*a* and 16*a*, it is possible to control the forward movement of the two slides 7 which, due to their short stroke, instantaneously bring the rectilinear sections of the toothed belts 1 into contact with the material 3 for making the bags, on the outside of the tubular guide element 2. As soon as the belts 1 come into contact with the strip of material 3, and exert the correct amount of pressure, they pull forward the strip of material by friction, by a sufficient length to make a bag, that is to say, until the control unit 17 causes the slides 7 to move backwards, by inverting the flow of fluid under pressure to the two control cylinders 9. At this point, and in a per se known way, a control signal is given to the machine for filling the bag formed at the lower end of the tubular element 2, and for sealing and cutting it by means of cutting and sealing units 18, which are represented schematically.

After having filled a bag, the device is operated again in order to move forward the belts 1, which are kept constantly in rotation, until they are brought once again into contact with the strip material 3. The belts 1 are kept in that position for the programmed and necessary length of time to feed forward a length of strip material 3 corresponding to the bag to be formed. The previously described work cycle is thus repeated, automatically forming and filling new bags at each cycle; the operating cycle can be kept extremely short and frequent, thanks to the rapid movements of the slides supporting the feeding belts 1, due to the fact that the belts themselves are made to rotate continuously. This avoids having strip feeding members 1 subject to frequently repeated sudden starting and stopping phases, and ensuring a sturdily constructed and highly reliable device. The stroke of the cylinders 9 can, of course, be calculated in order to adapt to tubular elements 2 of different diameters, whilst ensuring a constant feeding pressure.

What is claimed is:

1. A feeding device for feeding a flexible strip material in the form of tubing to form bags in a bag-filling machine which fills the bags with a loose material and cuts the bags, said feeding device comprising:

control means for controlling the fabrication and the filling of the bags;

a tubular element for delivering the loose material to be packaged in the bags;

feeding means, located to supply the strip material to said tubular element, said feeding means including at least two opposing feed elements operating continuously; and slide means for each of said feed elements, wherein each of said slide means is responsive to said control means for slidably carrying a feed element inwardly to an operative position in which the element frictionally engages the strip material to supply a predetermined length of material to said tubular element to form a bag, and outwardly to a retracted position in which the feed element disengages the strip material while the bag is filled and cut.

2. A device as claimed in claim 1 wherein said control means further comprises a hydraulic system including hydraulic cylinders connected to said slide means and solenoid valves connected to said cylinders, said solenoid valves controlling the stroke of said cylinders and therefore said slide means.

3. A device as claimed in claim 2 in which said control means is programmable.

4. A device as claimed in claim 2 further comprising supplementary means, connected to said slide means and responsive to said controller, for moving said slide means outwardly beyond said retracted position.

5. A device as claimed in claim 4, wherein said supplementary means comprises supplementary cylinders, said supplementary cylinders being connected to said solenoid valves in said hydraulic system.

6. A device as claimed in claim 5, wherein the stroke of said supplementary cylinders is relatively longer than the stroke of said cylinders.

7. A device as claimed in claim 1, wherein each of said feed elements comprises a toothed belt and each of said belts has a linear section that is parallel with said tubular element.

* * * * *